US010119361B2

(12) United States Patent
Telfer et al.

(10) Patent No.: US 10,119,361 B2
(45) Date of Patent: Nov. 6, 2018

(54) WINDOW ASSEMBLY WITH BYPASS RESTRICTOR

(71) Applicant: Halliburton Energy Services, Inc., Houston, TX (US)

(72) Inventors: Stuart Alexander Telfer, Aberdeenshire (GB); William Shuan Renshaw, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 296 days.

(21) Appl. No.: 15/029,003

(22) PCT Filed: Nov. 14, 2013

(86) PCT No.: PCT/US2013/070036
§ 371 (c)(1),
(2) Date: Apr. 13, 2016

(87) PCT Pub. No.: WO2015/072998
PCT Pub. Date: May 21, 2015

(65) Prior Publication Data

US 2016/0273301 A1 Sep. 22, 2016

(51) Int. Cl.
*E21B 33/16* (2006.01)
*E21B 33/14* (2006.01)

(52) U.S. Cl.
CPC ..... *E21B 33/16* (2013.01); *E21B 33/14* (2013.01)

(58) Field of Classification Search
CPC ..... E21B 33/14; E21B 17/00; E21B 33/16
See application file for complete search history.

(56) References Cited

U.S. PATENT DOCUMENTS 3,385,367 A 5/1968 Kollsman
5,404,945 A 4/1995 Head et al.
5,437,330 A * 8/1995 Gambertoglio ..... E21B 33/146 166/154
6,834,725 B2 12/2004 Whanger et al.
7,059,415 B2 6/2006 Bosma et al.
7,143,832 B2 12/2006 Freyer et al.
(Continued)

FOREIGN PATENT DOCUMENTS

CN 1708630 12/2005
CN 202023528 11/2011
(Continued)

OTHER PUBLICATIONS

Chinese Application No. 2013800801643, Office Action dated May 24, 2017, 17 pages (9 pages of English Translation and 8 pages of original document).
(Continued)

*Primary Examiner* — Michael R Wills, III
(74) *Attorney, Agent, or Firm* — Kilpatrick Townsend & Stockton LLP

(57) ABSTRACT

In some aspects, a downhole assembly is provided that can include a window joint positioned within a tubular element and a bypass restrictor. The bypass restrictor can be positioned in an annulus between an outer surface of the window joint and an inner surface of the tubular element. The bypass restrictor can restrict the flow of a pressurized fluid via the annulus from a first end to a second end of a wiper plug.

14 Claims, 5 Drawing Sheets

(56) References Cited

U.S. PATENT DOCUMENTS

| | | | | |
|---|---|---|---|---|
| 7,213,652 | B2 | 5/2007 | Hepburn et al. | |
| 7,228,915 | B2 | 6/2007 | Thomson et al. | |
| 7,578,354 | B2 | 8/2009 | Thomson et al. | |
| 7,584,795 | B2 | 9/2009 | Hepburn et al. | |
| 7,708,068 | B2 | 5/2010 | Hailey, Jr. | |
| 7,891,431 | B2 | 2/2011 | Freyer et al. | |
| 7,946,351 | B2 | 5/2011 | Freyer et al. | |
| 8,091,246 | B2 | 1/2012 | Hepburn | |
| 8,312,931 | B2 | 11/2012 | Xu et al. | |
| 8,408,315 | B2 | 4/2013 | Docherty et al. | |
| 9,200,499 | B2 * | 12/2015 | Hall | E21B 33/16 |
| 2002/0003040 | A1 | 1/2002 | Brunet | |
| 2004/0020662 | A1 | 2/2004 | Freyer | |
| 2005/0103492 | A1 | 5/2005 | Szarka | |
| 2007/0034386 | A1 | 2/2007 | Henry et al. | |
| 2007/0158060 | A1 | 7/2007 | Baaijens et al. | |
| 2008/0099201 | A1 | 5/2008 | Sponchia et al. | |
| 2010/0126722 | A1 | 5/2010 | Cornelissen et al. | |
| 2010/0139930 | A1 | 6/2010 | Patel et al. | |
| 2010/0294503 | A1 * | 11/2010 | Laurel | E21B 33/05 166/335 |
| 2011/0067863 | A1 | 3/2011 | Peixoto et al. | |
| 2012/0012343 | A1 | 1/2012 | Wilkin et al. | |
| 2012/0132442 | A1 | 5/2012 | Head | |
| 2012/0145412 | A1 | 6/2012 | Andersen et al. | |
| 2012/0145414 | A1 | 6/2012 | Nutley et al. | |
| 2013/0037267 | A1 | 2/2013 | Regnault de la Mothe et al. | |

FOREIGN PATENT DOCUMENTS

| | | |
|---|---|---|
| WO | 9914461 | 3/1999 |
| WO | 2011020987 | 2/2011 |

OTHER PUBLICATIONS

European Application No. 13897357.3, Extended European Search Report dated Jul. 12, 2017, 9 pages.

Halliburton, "Developing the Heavy Oil and Oil Sands Assets", available online at http://www.halliburton.com/public/common/Brochures/H06153.pdf, at least as early as Mar. 2008, 46 pages.

Halliburton, "Swell Technology™ Systems", available online at at http://www.halliburton.com/public/cps/contents/Books_and_Catalogs/web/CPSCatalog/04_Swell%20Technology.pdf, at least as early as Jul. 8, 2013, 18 pages.

International Patent Application No. PCT/US2013/070036, "International Search Report and Written Opinion", dated Aug. 20, 2014, 17 pages.

Australian Application No. 2013405218, First Examiner Report dated May 30, 2016, 2 pages.

* cited by examiner

WINDOW ASSEMBLY WITH BYPASS RESTRICTOR

CROSS-REFERENCE TO RELATED APPLICATIONS

This is a U.S. national phase under 35 U.S.C. 371 of International Patent Application No. PCT/US2013/070036, titled "WINDOW ASSEMBLY WITH BYPASS RESTRICTOR" filed Nov. 14, 2013, the entirety of which is incorporated herein by reference.

TECHNICAL FIELD

The present disclosure relates generally to devices for use in a wellbore in a subterranean formation and, more particularly (although not necessarily exclusively), to window assemblies used during cementing operations in a well system.

BACKGROUND

Preparing a well assembly traversing a hydrocarbon bearing subterranean formation can involve cementing operations that pump cement into place in a wellbore. Cementing operations can seal an annulus between a casing string and a subterranean formation after the casing string has been run into the wellbore. A wiper plug (also known as a "cementing plug") can be used to separate cement slurry from other fluids during cementing operations. Inadequate separation between the cement slurry and other fluids can reduce the predictability of cement characteristics, result in cement having unfavorable characteristics (e.g., decreased strength, increased curing time, etc.), or both.

DETAILED DESCRIPTION

Certain aspects of the present disclosure are directed to window assemblies in a casing string or tubing liner used during cementing operations. A window assembly can include a window joint. The window joint can include a partial tube section (such as a half-pipe). The window joint can be aligned within and positioned along an inner edge of a tubular casing joint in a casing string. The casing joint with the window joint can include an annular clearance between the window joint and the casing joint that can facilitate manufacturing assembly. Pumping a wiper plug past the window joint during a cementing operation can allow pumping fluids to bypass the plug via the annular clearance. The annular bypass at the window joint can stall the progress of the wiper plug at low flow rates and prevent further passage of the wiper plug. The window assembly can include a bypass restrictor installed in the annular clearance. The bypass restrictor can reduce the annular bypass. Reducing the annular bypass can reduce or prevent occurrence of stalling of the wiper plug at low flow rates. In one example, the bypass restrictor can include a swellable rubber coating applied to the outer diameter of the window joint during manufacturing of the window assembly. The swellable rubber coating can swell in response to contact with a setting fluid. In one example, the rubber coating can swell in response to hydrocarbons present in the setting fluid. Swelling of the rubber coating can cause the internal annular clearance to be reduced. Reducing the internal annular clearance can allow low-flow cementing operations to occur without plug stalling occurring.

These illustrative examples are given to introduce the reader to the general subject matter discussed here and are not intended to limit the scope of the disclosed concepts. The following describes various additional aspects and examples with reference to the drawings in which like numerals indicate like elements, and directional descriptions are used to describe the illustrative aspects. The following uses directional descriptions such as "uphole," "downhole," etc. in relation to the illustrative aspects as they are depicted in the figures, the uphole direction being toward the surface of the well and the downhole direction being toward the toe of the well. Like the illustrative aspects, the numerals and directional descriptions included in the following sections should not be used to limit the present disclosure.

Figure 1:
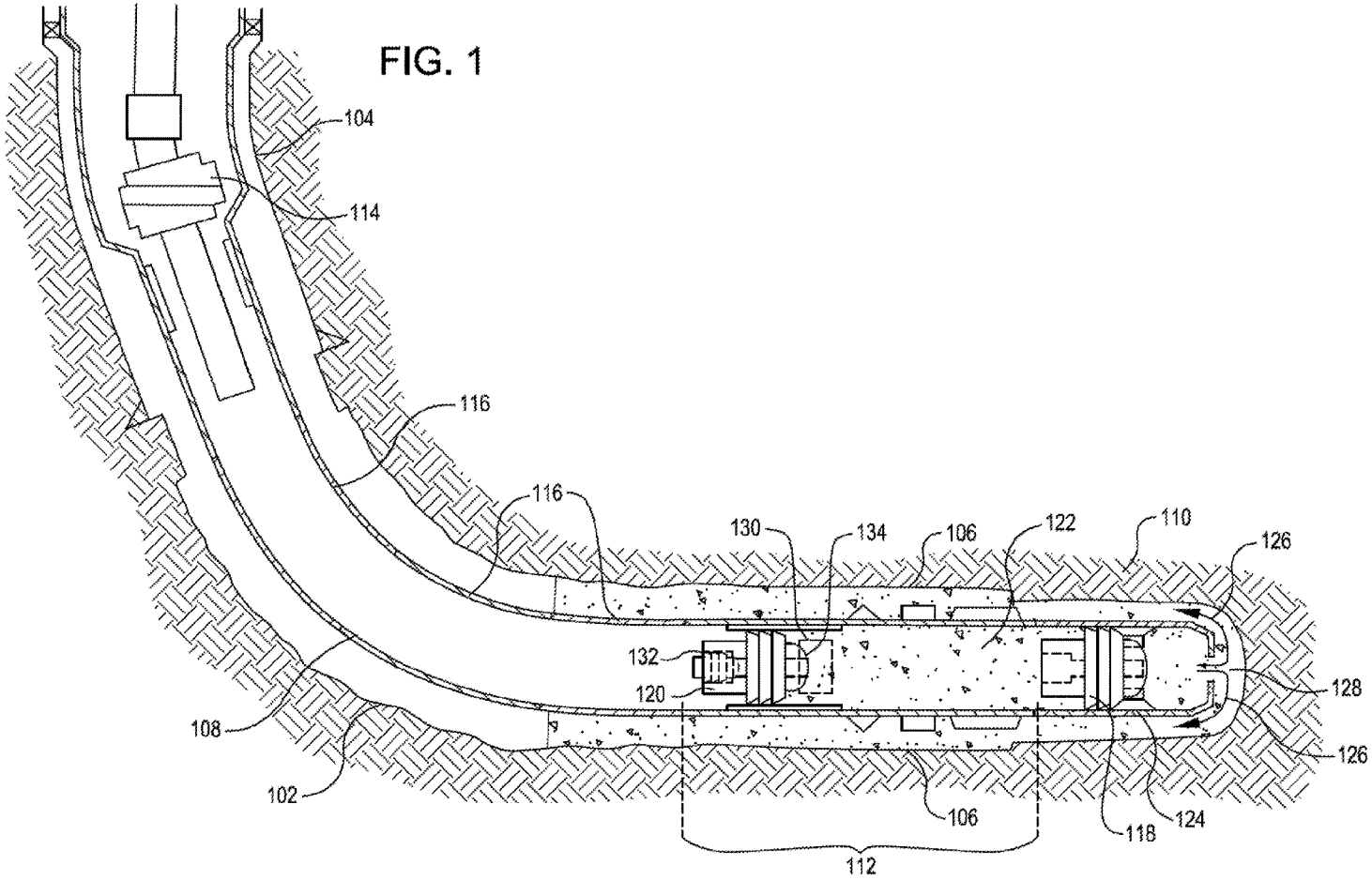
FIG. 1 is a schematic illustration of a cementing operation in a well assembly having a window assembly according to one aspect of the present disclosure.

FIG. 1 schematically depicts an example of cementing operation in a well system 100 having a window assembly 112. The well system 100 includes a bore that is a wellbore 102 extending through various earth strata. The wellbore 102 has a substantially vertical section 104 and a substantially horizontal section 106. The substantially horizontal section 106 extends through a hydrocarbon bearing subterranean formation 110. A casing string 108 positioned in the substantially vertical section 104 can extend into the horizontal section 106.

The casing string 108 can be cemented in place in the wellbore 102. Cementing the casing string 108 in place can stabilize the wellbore 102 for operations in the well system 100. For example, the casing string 108 can reduce erosion of a wall of the wellbore 102 or isolate portions of the formation 110 having different characteristics.

The casing string 108 can include a plurality of casing joints 116. The casing joints 116 can be tubular elements. The casing joints 116 can be made of any suitable material. Non-limiting examples include steel, aluminum, titanium, and fiberglass. The casing string 108 can include one or more window assembly 112. The window assembly 112 can provide an opening 130 through the casing string 108 for passage of tools used in operation of the well system 100. An example of a window assembly 112 is described in detail with respect to FIG. 2-7 below.

Although FIG. 1 depicts the window assembly 112 in the substantially horizontal section 106, the window assembly 112 can be located, additionally or alternatively, in the substantially vertical section 104. In some aspects, the window assembly 112 can be disposed in simpler wellbores, such as wellbores having only a substantially vertical section 104.

A running tool 114 can be inserted into the wellbore 102 for delivering sections of the casing string 108 (such as casing joints 116, window assembly 112, or both) into the wellbore 102. The running tool 114 can position and align the sections of the casing string 108 together to form the casing string 108.

A cementing operation can secure the casing string 108 in place in the wellbore 102. Cement slurry 122 can be pumped through the interior of the casing string 108 to a downhole end of the casing string 108. Cement slurry 122 exiting through the downhole end 128 of the casing string 108 can displace around the casing string 108 (as depicted by the flow arrows 126 in FIG. 1) to fill a void between the exterior of the casing string 108 and the formation 110. The cement slurry 122 can harden and solidify into cured cement over a period of time. The cured cement can fix the casing string 108 in position relative to the wellbore 102.

A bottom plug 118 can be deployed into the casing string 108 ahead of the cement slurry 122 to separate the cement slurry 122 from other fluids present in the casing string 108. In a non-limiting example, the bottom plug 118 can include one or more flexible radial wipers that can conform to a cross-sectional area of an interior of the casing string 108 to prevent fluid on one side of the wiper(s) from passing through the cross-sectional area to mix with fluid on the other side of the wiper(s). The bottom plug 118 can travel through the casing string 108 and contact a landing collar 124. Contact between the bottom plug 118 and the landing collar 124 can stop the movement of the bottom plug 118 through the casing string 108. In the stopped position, a diaphragm in the bottom plug 118 can rupture to allow cement slurry 122 to flow through the bottom plug 118 and out through the downhole end of the casing string 108.

A top plug 120 can be deployed into the casing string 108 behind the cement slurry 122. Fluid can be pumped behind the top plug 120 for propelling the top plug 120 through the casing string 108. The top plug 120 can provide a barrier between the pumped fluid and the cement slurry 122. The pumped fluid can communicate a pressure to the uphole end 132 of the top plug 120. In response, a downhole end 134 of the top plug 120 can communicate a pressure to the cement slurry 122. Pressure communicated to the cement slurry 122 via the top plug 120 can propel the cement slurry 122 through the casing string 108 during the cementing operation. Continued pumping of fluid into the casing string 108 can displace a suitable amount of cement slurry 122 through the downhole end of the casing string 108 to hold the casing string 108 in place relative to the formation 110.

Figure 2:
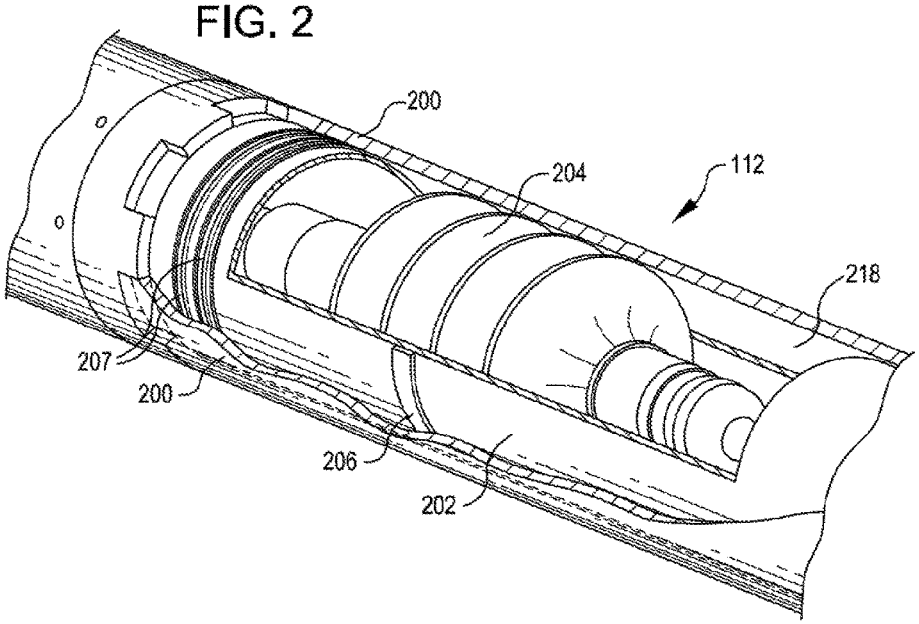
FIG. 2 is a perspective cutaway view of an example of a window assembly according to one aspect of the present disclosure.
Figure 3:
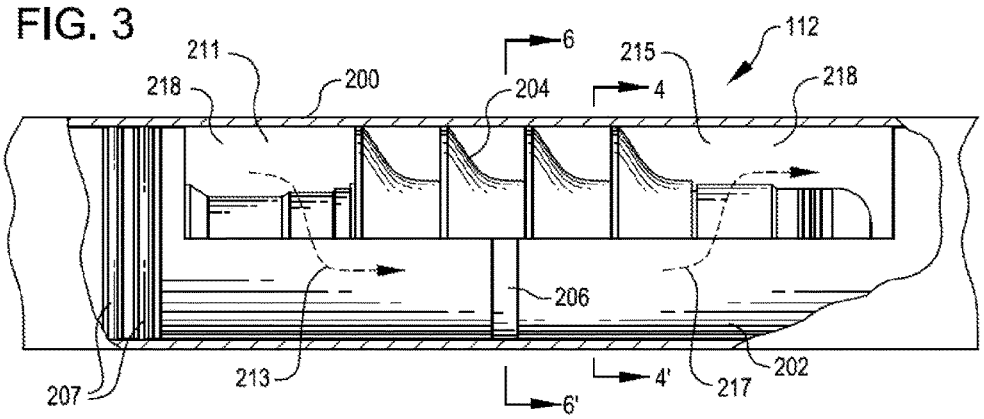
FIG. 3 is a side cutaway view of the window assembly of FIG. 2 according to one aspect of the present disclosure.

FIGS. 2-3 are respectively a perspective cutaway view and a side cutaway view of an example of a window assembly 112. FIGS. 2-3 depict a wiper plug 204 positioned within the window assembly 112. The wiper plug 204 may be a top plug or a bottom plug, such as the top plug 120 or bottom plug 118 described with respect to FIG. 1. The wiper plug 204 may pass through the window assembly 112 in a cementing operation as described above with respect to FIG. 1.

The window assembly 112 can include a tubular element 200, a window joint 202, one or more bypass restrictors 206, and one or more positioning elements 207. The tubular element 200 and the window joint 202 can each be tubular parts. The tubular element 200 may be a casing joint, such as a casing joint 116 described with respect to FIG. 1. In one non-limiting example, the tubular element 200 is an aluminum tube. The window joint 202 can be sized for nesting within the tubular element 200. For example, the window joint 202 can have an outer diameter that is slightly smaller than an inner diameter of the tubular element 200.

A section of the tubular element 200 is depicted in FIGS. 2-3 as cut away for illustrative purposes to better show the inner contents of the window assembly 112. The window joint 202 can be positioned within the tubular element 200. The one or more positioning elements 207 can align the window joint 202 within the tubular element 200. For example, the positioning elements 207 may radially align the window joint 202 concentrically within the tubular element 200. Non-limiting examples of positioning elements include o-rings, v-rings, or shims.

The window joint 202 can have an open section to provide a window 218 through the window joint 202. For example, the window 218 can be an opening radially extending through the window joint 202. The window 218 can provide a section of the casing string 108 that is penetrable for providing a radial or lateral hole through the casing string 108. For example, a downhole tool, such as a drilling tool, can pass through the window 218 to drill in a direction lateral to the casing string. In one non-limiting example, a portion corresponding to approximately one half of the circumference of the window joint 202 can be cut away to provide the window 218, as depicted in FIG. 2-3. In other non-limiting examples, the window 218 may correspond to a different fraction of the circumference of the window joint 202. In some aspects, the window joint 202 can be milled to provide the window 218 prior to installation of the window joint 202 into the tubular element 200.

The bypass restrictor 206 can be positioned between the window joint 202 and the tubular element 200. Examples of a bypass restrictor 206 are described with respect to FIG. 6-7 below. Although the window assembly 112 is depicted in FIG. 2-3 with one bypass restrictor 206 positioned near a center of the window 218, other arrangements are possible. A number of non-limiting examples of such arrangements are described with respect to FIGS. 8-9 below.

Figure 4:
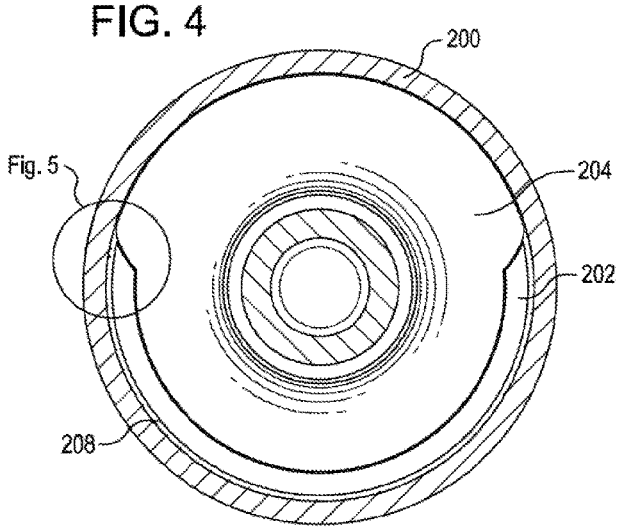
FIG. 4 is a cross-sectional view of the window assembly of FIGS. 2-3 depicting an example of an annular clearance according to one aspect of the present disclosure.
Figure 5:
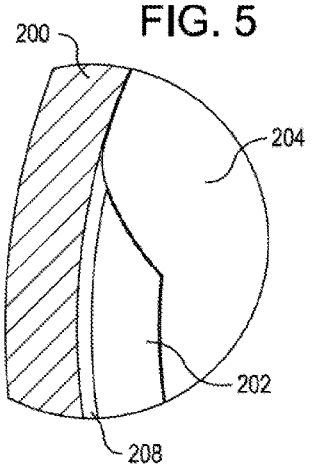
FIG. 5 is a detail view of the annular clearance of FIG. 4 according to one aspect of the present disclosure.

FIG. 4 is a cross-sectional view taken along the line 4-4' in FIG. 3 of the window assembly 112 of FIGS. 2-3. The window assembly 112 can include an annular clearance 208 between the tubular element 200 and the window joint 202. FIG. 5 is a detail view of the annular clearance 208 of FIG. 4.

The annular clearance 208 may be present for ease of manufacture of the window assembly 112. For example, the window joint 202 can have an outer diameter slightly smaller than an inner diameter of the tubular element 200. The difference in diameters can result in the annular clearance 208. The annular clearance 208 can reduce interference between the window joint 202 and the tubular element 200 that might otherwise hinder insertion of the window joint 202 into the tubular element 200 during assembly.

In the absence of a bypass restrictor 206, the annular clearance 208 may also allow unobstructed fluid passage between the window joint 202 and the tubular element 200. In some aspects, the annular clearance 208 can provide a flow path by which fluid can bypass a wiper plug 204 positioned in the window assembly 112. For example, fluid uphole of the wiper plug 204 may flow via an uphole portion 211 of the window 218 into the annular clearance 208, such as illustrated by the arrow 213 depicted in FIG. 3. In the absence of a bypass restrictor 206, the fluid may bypass the wiper plug 204 by flowing through the annular clearance 208 and through a downhole portion 215 of the window 218, such as illustrated by the arrow 217 depicted in FIG. 3. Bypass of the wiper plug 204 can have negative effects. In one non-limiting example, bypass of the wiper plug 204 can cause contamination of cement slurry 122 by other fluids present in the casing string 108. In another non-limiting example, bypass of the wiper plug 204 can reduce the amount of pressure communicated to the wiper plug 204.

In some aspects, reducing the amount of pressure communicated to the wiper plug 204 may cause a reduction in the travelling speed of the wiper plug 204 or cause the wiper plug 204 to stall. Stalling can be more likely at lower pump rates. For example, a wiper plug 204 may stall in response to being propelled by a low pump flow rate, such as (for example) 400 liters (14.13 cubic feet) per minute through a window joint 202 with an outer diameter of 24.45 centimeters (9⅝ inches) in an aluminum casing joint 116 having an inner diameter of 24.61 centimeters (9 11/16 inches). The same wiper plug 204 propelled through the same window joint 202 may not stall in response to higher pump rates, such as a pump flow rate of 800 liters (28.25 cubic feet) per minute.

Figure 6:
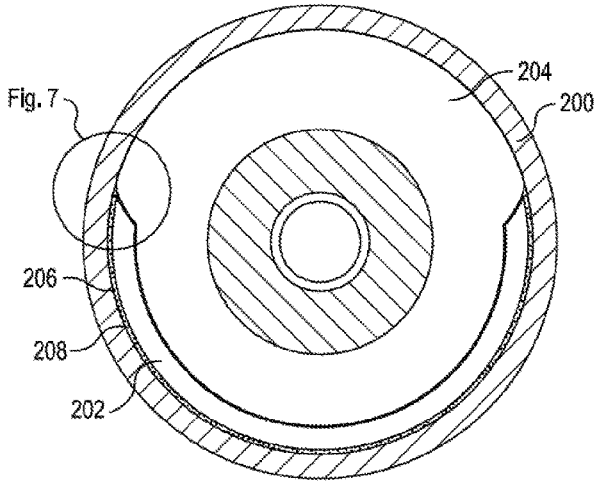
FIG. 6 is a cross-sectional view of the window assembly of FIGS. 2-3 depicting an example of a bypass restrictor according to one aspect of the present disclosure.
Figure 7:
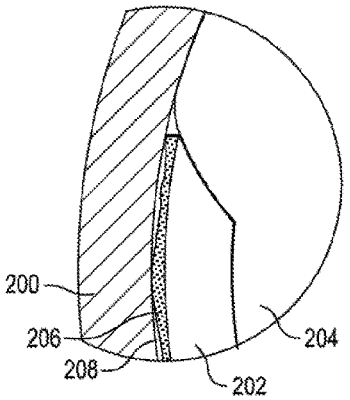
FIG. 7 is a detail view of the bypass restrictor of FIG. 6 according to one aspect of the present disclosure.

The bypass restrictor 206 can reduce or prevent contamination of cement slurry 122 or stalling associated with fluid flow through the annular clearance 208. FIG. 6 is a cross-sectional view taken along the lines 6-6' in FIG. 3 of the window assembly 112. A bypass restrictor 206 can be positioned in the annular clearance 208. FIG. 7 is a detail view of the bypass restrictor 206 of FIG. 6.

The bypass restrictor 206 may include a filler material. The bypass restrictor 206 can have a void-filling effect in the annular clearance 208. Void-filling in the annular clearance 208 can restrict fluid flow through the annular clearance 208. In one example, the bypass restrictor 206 can fill a portion of the annular clearance 208 to reduce a cross-sectional profile of the annular clearance 208 through which fluid can flow. Restricting fluid flow through the annular clearance 208 can reduce an amount of fluid bypass via the annular clearance 208. In some aspects, the bypass restrictor 206 can seal off the annular clearance 208 and prevent fluid flow through the annular clearance 208. In other aspects, the bypass restrictor 206 can occupy a portion of the annular clearance 208 and allow fluid flow through the unoccupied remainder of the annular clearance 208.

In some aspects, the bypass restrictor 206 can be formed from a material that is initially liquid and then sets. Non-limiting examples of such bypass restrictors 206 include one or more layers of epoxy, one or more layers of resin, or one or more layers of a hardening foam. In some aspects, the hardened form of the material forming the bypass restrictor 206 can be sufficiently ductile to allow the bypass restrictor 206 to withstand vibrations and other motion common to downhole assemblies that might otherwise affect the structural integrity of the bypass restrictor 206 or impair the function of the bypass restrictor 206.

In some aspects, the material for a bypass restrictor 206 may swell or expand upon setting. The swelling or expansion can obstruct part or all of the annulus between the window joint 202 and the tubular element 200 to reduce an amount of bypass through the annular clearance 208.

In one example, the bypass restrictor 206 is a coat of swellable material. The swellable material can swell in response to contact with a setting fluid. A setting fluid can include a compound that chemically reacts with the swellable material to cause swelling of the swellable material. In some aspects, the swellable material can swell as a result of an increase in volume of the material. In some aspects, the increase in volume results from incorporation of molecular components of the setting fluid into the swellable material itself. In one non-limiting example, the swellable material is responsive to setting fluids containing water. Contact between the swellable material and water contained in the setting fluid can initiate the swelling process. Water molecules contained in the setting fluid can be incorporated into the swellable material, thereby increasing the volume of the swellable material. In another non-limiting example, the swellable material is responsive to setting fluids containing hydrocarbon. In a further non-limiting example, the swellable material is responsive to setting fluids containing both water and hydrocarbon.

Various swellable materials and corresponding setting fluids can be utilized according to differing aspects. Non-limiting examples of swellable materials that can swell in response to oil or another setting fluid containing hydrocarbon include: natural rubber, nitrile rubber, hydrogenated nitrile rubber, acrylate butadiene rubber, poly acrylate rubber, butyl rubber, brominated butyl rubber, chlorinated butyl rubber, chlorinated polyethylene, polychloroprene (neoprene) rubber, styrene butadiene copolymer rubber, sulphonated polyethylene, ethylene acrylate rubber, epichlorohydrin ethylene oxide copolymer, ethylene-propylene-copolymer (peroxide cross-linked), ethylene-propylene-copolymer (sulphur cross-linked), ethylenepropylene-diene terpolymer rubber, ethylene vinyl acetate copolymer, fluoro rubbers, fluoro silicone rubber, and silicone rubbers. Non-limiting examples of swellable materials that can swell in response to setting fluid containing water include: starch-polyacrylate acid graft copolymer, polyvinyl alcohol cyclic acid anhydride graft copolymer, isobutylene maleic anhydride, acrylic acid type polymers, vinylacetate-acrylate copolymer, polyethylene oxide polymers, carboxymethyl cellulose type polymers, starch-polyacrylonitrile graft copolymers, and highly swelling clay minerals such as sodium bentonite (having as main ingredient montmorillonite).

The swellable material can be attached to an exterior surface or outer diameter of the window joint 202, or to an interior surface of the tubular element 200, or both. Swelling of the swellable material can reduce or eliminate a cross-section of the annular clearance 208 through which fluid can flow or through which fluid bypass can occur. In some aspects, the swellable material can be swollen during the manufacturing process, such as after the window joint 202 is inserted into the tubular element 200. In other aspects, the coating of swellable material can be applied during manufacturing and exposed to a setting fluid for swelling while the window assembly 112 is disposed in the wellbore 102. For example, the swellable material may be exposed to a setting fluid present in the wellbore 102 or to a setting fluid pumped from a surface unit through the casing string 108.

In another example, the bypass restrictor 206 can be a layer of grease. In some aspects, the grease can remain in place relative to the window joint 202. For example, the characteristics of the grease (such as viscosity or friction) may allow the grease to resist pressure applied to the grease by other fluids present in the casing string 108. In other aspects, the grease can move relative to the window joint 202. For example, the characteristics of the grease (such as viscosity or friction) may permit the grease to move at a slower rate along a longitudinal length of the exterior of the window joint 202 than a rate of movement of the wiper plug 204 along the longitudinal length of the interior of the window joint 202. Movement of the grease at a slower rate may reduce fluid bypass sufficiently to allow the wiper plug 204 to move past the window joint 202 before the grease is flushed completely out of the annular clearance 208.

Figure 8:
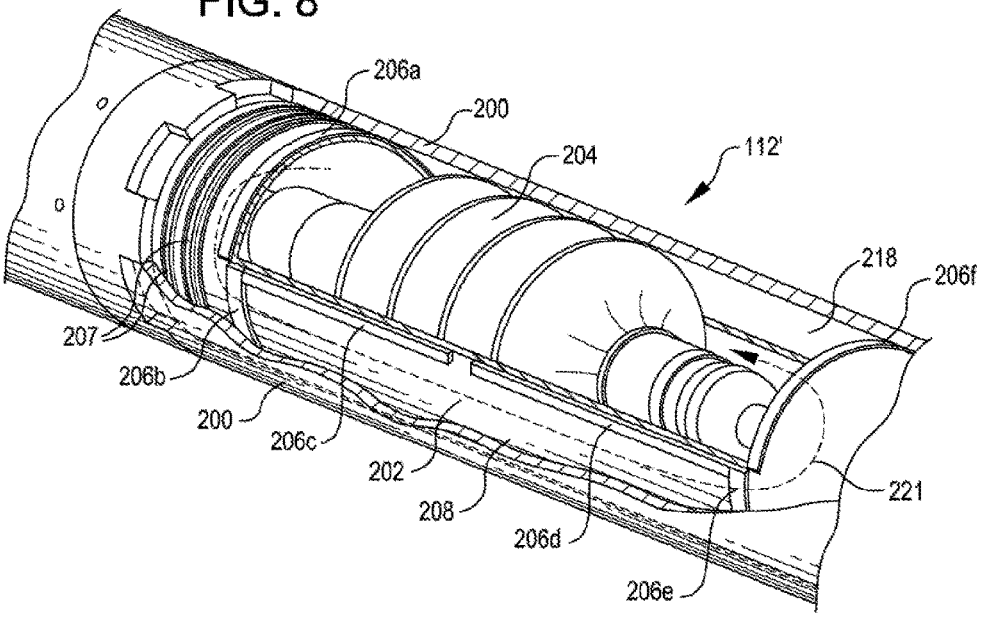
FIG. 8 is a perspective cutaway view of another example of a window assembly according to one aspect of the present disclosure.

FIG. 8 is a perspective cutaway view of another example of a window assembly 112'. The window assembly 112' can include a tubular element 200, a window joint 202, one or more bypass restrictors 206, and one or more positioning elements 207. Features depicted in FIG. 8 can have similar structure and function as features with corresponding reference numerals described above with respect to FIG. 2-7.

Various arrangements of bypass restrictors 206 are possible. In some aspects, one or more bypass restrictors 206 can be positioned along a longitudinal edge of the window 218. Non-limiting examples include the bypass restrictors 206*c* and 206*d* depicted in FIG. 8. Although the bypass restrictors 206*c* and 206*d* are depicted in FIG. 8 as arranged in strips along portions of the longitudinal edge of the window 218, other arrangements are possible. The bypass restrictors 206*c* and 206*d* may be arranged to extend along an entire length of the longitudinal edge of the window 218. More or fewer than two bypass restrictors 206*c* and 206*d* can be arranged along the longitudinal edge of the window 218. The thickness of the strips of the bypass restrictors 206*c* and 206*d* can be greater or smaller than depicted in FIG. 8. In one non-limiting example, the thickness of the bypass restrictors 206*c* or 206*d* may be sufficiently large for the bypass restrictors 206*c* or 206*d* to span an outer perimeter of the window joint 202. In another non-limiting example, a bypass restrictor 206*c* or 206*d* can be positioned continuously along an entirety of the outer surface of the window joint 202 facing the inner surface of the tubular element 200.

In some aspects, one or more bypass restrictors 206 can be positioned along a radial edge of the window 218. Non-limiting examples include the bypass restrictors 206*a* and 206*f* depicted in FIG. 8. In some aspects, one or more bypass restrictors 206 can be positioned radially along an outer surface of the window joint 202. Non-limiting examples include the bypass restrictors 206*b* and 206*e* depicted in FIG. 8. Positioning at least one radially arranged bypass restrictor (e.g., 206*a*, 206*f*, 206*b*, or 206*e*) in the window assembly 112' can reduce fluid bypass of a wiper plug 204 that might otherwise occur. In one example, bypass restrictors 206*c* and 206*d* are included in the window assembly 112' along a longitudinal edge of the window 218 to prevent flow of fluid past the longitudinal edge of the window 218. In this arrangement, one or more radially arranged bypass restrictors (e.g., 206*a*, 206*f*, 206*b*, 206*e*, or some combination thereof) may prevent fluid flow (such as depicted by the arrow 221) around the bypass restrictors 206*c* and 206*d* via radial edges of the window 218 and the annular clearance 208. In some aspects, a bypass restrictor 206*b* or 206*e* positioned radially along an outer surface of the window joint 202 may extend along an entire length of the window 218.

Figure 9:
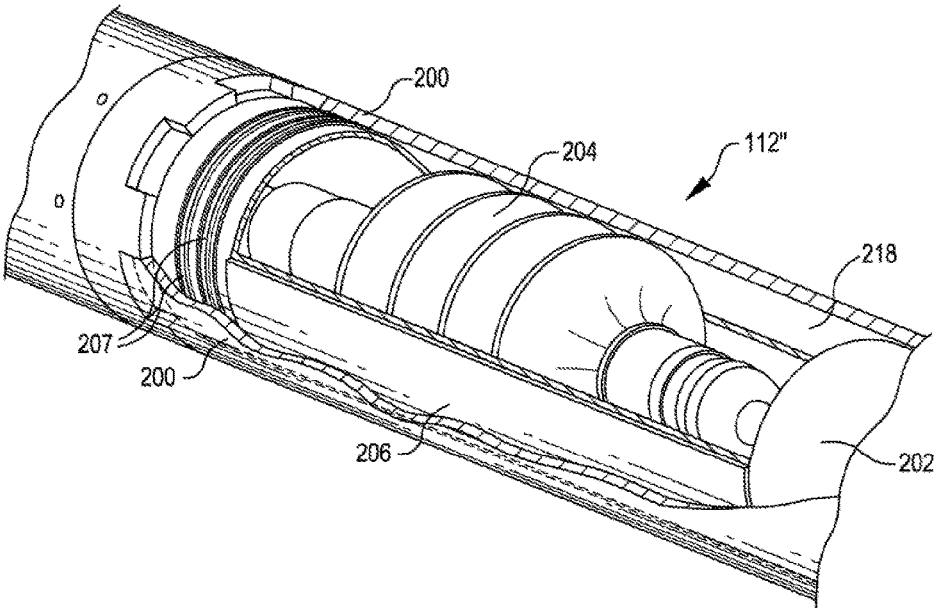
FIG. 9 is a perspective cutaway view of yet another example of a window assembly according to one aspect of the present disclosure.

FIG. 9 is a perspective cutaway view of yet another example of a window assembly. The window assembly 112" can include a tubular element 200, a window joint 202, one or more bypass restrictors 206, and one or more positioning elements 207. Features depicted in FIG. 9 can have similar structure and function as features with corresponding reference numerals described above with respect to FIG. 2-8. In some aspects, the bypass restrictor 206 can extend the length of the window 218. The bypass restrictor can be positioned between the outer surface of the window joint 202 and the inner surface of the tubular element 200. In one non-limiting example, the bypass restrictor 206 can be positioned along the outer surface of the window joint 202 facing the inner surface of the tubular element 200. In another non-limiting example, the bypass restrictor 206 can be positioned along the inner surface of the tubular element 200 facing the outer surface of the window joint 202.

Figure 10:
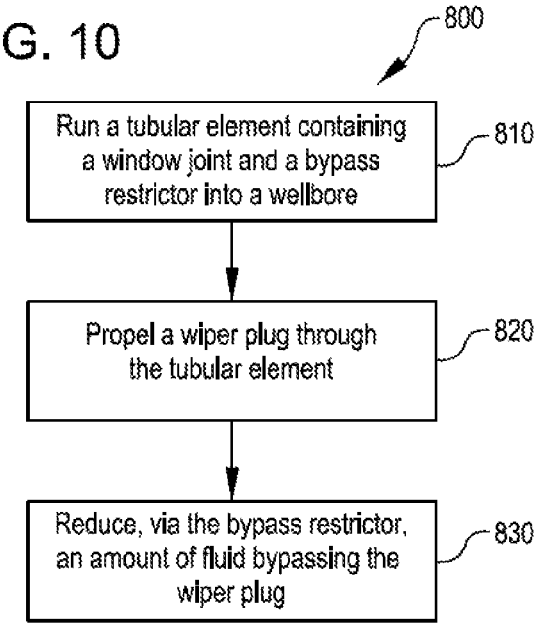
FIG. 10 is a flow chart illustrating an example method for cementing a casing string having a window assembly according to one aspect of the present disclosure.

A casing string 108 having a window assembly 112 can be cemented in a wellbore 102 according to a cementing process. For example, FIG. 10 is a flow chart illustrating an example method 800 for cementing a casing string 108 having a window assembly 112 according to one aspect of the present disclosure.

The method 800 involves running a tubular element 200 containing a window joint 202 and a bypass restrictor 206 into a wellbore 102, as shown in block 810. For example, as described above with respect to FIG. 1, a running tool 114 can deliver a window assembly 112 into the wellbore. The window joint 202 can be positioned within the tubular element 200. The bypass restrictor 206 can be positioned in an annulus between an outer surface of the window joint 202 and an inner surface of the tubular element 200.

The method 800 further involves propelling a wiper plug 204 through the tubular element 200, as shown in block 820. For example, as described above with respect to FIG. 1, the wiper plug 204 can be propelled as part of a cementing process. The process can involve introducing cement slurry 122 into the tubular element 200, introducing the wiper plug 204 as a top plug 120 into the tubular element behind the cement slurry 122, and introducing a pressurized fluid into the tubular element 200 behind the wiper plug 204. The pressurized fluid can propel the wiper plug 204 through the tubular element 200 into contact with the cement slurry 122. The cement slurry can move through the tubular element 200 in response to movement of the wiper plug 204. The wiper plug 204 can be propelled via the pressurized fluid in contact with the wiper plug 204. The wiper plug 204 can be propelled over the window joint 202 and the bypass restrictor 206. For example, the wiper plug 204 can be propelled through the tubular element through an inner region between an inner surface of the tubular element 200 and an inner surface of the window joint 202.

The method 800 further involves reducing, via the bypass restrictor 206, an amount of fluid bypassing the wiper plug 204, as shown in block 830. For example, as described above with respect to FIG. 6, the bypass restrictor 206 can include a filler material positioned in the annular clearance 208 to restrict fluid flow through the annular clearance 208. Restricting fluid flow through the annular clearance 208 can reduce an amount of fluid bypass via the annular clearance 208.

In some aspects, a window assembly is provided in a downhole assembly. The downhole assembly may be part of a casing string or tubing liner used during cementing operations. The downhole assembly can include a window joint and a bypass restrictor. The window joint can have an opening radially extending through the window joint. The window joint can be positionable within a tubular element of a casing string. The bypass restrictor can be positionable adjacent to the opening. The bypass restrictor can be positionable in an annulus between an outer surface of the window joint and an inner surface of the tubular element. The bypass restrictor can be operable for restricting a flow of a pressurized fluid via the opening and the annulus from a first end to a second end of a wiper plug.

The downhole assembly may feature a bypass restrictor positioned along a longitudinal edge of the opening. The downhole assembly may feature a bypass restrictor positioned along a radial edge of the opening. The downhole assembly may feature a bypass restrictor positioned continuously along an entirety of the outer surface of the window joint facing the inner surface of the tubular element.

The downhole assembly may feature the wiper plug. The wiper plug can have at least one radial wiper conforming to a cross-sectional area of an interior of the tubular element. The at least one radial wiper can further conforming to a cross-sectional area bounded by an inner surface of the window joint and the inner surface of the tubular element. The wiper plug can be operable for pushing cement slurry contacting the second end through the tubular element in response to a pressure communicated to the first end by the pressurized fluid. The wiper plug can be further operable for pushing the cement slurry through the tubular element and over the window joint.

In some aspects, a downhole assembly is provided. The downhole assembly can include a tubular element, a wiper plug, a window joint, and a bypass restrictor. The wiper plug can have a first end, a second end, and at least one radial wiper. The at least one radial wiper can conform to a cross-sectional area of an interior of the tubular element. The at least one wiper can be operable for pushing cement slurry contacting the second end through the tubular element in response to a pressure communicated to the first end by a pressurized fluid. The window joint can be positioned within the tubular element. The window joint can have an opening radially extending through the window joint. The at least one radial wiper of the wiper plug can conform to a cross-sectional area bounded by an inner surface of the window joint and an inner surface of the tubular element. The wiper plug can be further operable for pushing the cement slurry through the window joint. The bypass restrictor can be positioned adjacent to the opening. The bypass restrictor can be positioned in an annulus between an outer surface of the window joint and the inner surface of the tubular element. The bypass restrictor can be operable for reducing an amount of passage of the pressurized fluid from the first end to the second end through the opening and the annulus.

The downhole assembly may feature a bypass restrictor that includes a filler material positioned in the annulus. The downhole assembly may feature a bypass restrictor that includes a layer of grease. The downhole assembly may feature a bypass restrictor that includes a layer of resin. The downhole assembly may feature a bypass restrictor that includes a layer of epoxy. The downhole assembly may feature a bypass restrictor that includes a layer of hardened foam.

The downhole assembly may feature a bypass restrictor that includes a layer of swellable material. The swellable material can be swellable in response to exposure to a setting fluid. The setting fluid may include water. The swellable material can be swellable in response to the water in the setting fluid. The setting fluid may include hydrocarbon. The swellable material can be swellable in response to the hydrocarbon in the setting fluid.

In some aspects, a method is provided for cementing a casing string having a tubular element with a window joint. The method can include running a tubular element into a wellbore. The tubular element can contain a window joint positioned within the tubular element and a bypass restrictor positioned in an annulus between an outer surface of the window joint and an inner surface of the tubular element. The method can include propelling a wiper plug via a pressurized fluid in contact with the wiper plug. The wiper plug can be propelled through the tubular element through an inner region between the inner surface of the tubular element and an inner surface of the window joint. The method can include reducing, via the bypass restrictor, an amount of pressurized fluid bypassing the wiper plug and the inner region via the annulus.

The method can also include introducing a setting fluid to the bypass restrictor in the annulus. The setting fluid can cause a material in the bypass restrictor to swell for reducing the amount of pressurized fluid bypassing the wiper plug and the inner region via the annulus. Introducing the setting fluid may include introducing the setting fluid to the bypass restrictor before running the tubular element into the wellbore. Introducing the setting fluid may include introducing the setting fluid to the bypass restrictor after running the tubular element into the wellbore. Introducing the setting fluid may include introducing a setting fluid including water. Introducing the setting fluid may include introducing a setting fluid including hydrocarbon.

The foregoing description of the aspects, including illustrated examples, of the disclosure has been presented only for the purpose of illustration and description and is not intended to be exhaustive or to limit the disclosure to the precise forms disclosed. Numerous modifications, adaptations, and uses thereof will be apparent to those skilled in the art without departing from the scope of this disclosure.

What is claimed is:

1. A downhole assembly for cementing operations, the assembly comprising:

a window joint having an opening radially extending through the window joint, the window joint positionable within a tubular element of a casing string; and a bypass restrictor positionable adjacent to the opening and in an annulus between an outer surface of the window joint and an inner surface of the tubular element, the bypass restrictor operable for restricting a flow of a pressurized fluid via the opening and the annulus from a first end to a second end of a wiper plug, wherein the bypass restrictor is fixed relative to the window joint in a downhole environment.

2. The downhole assembly of claim 1, wherein the bypass restrictor is positioned along a longitudinal edge of the opening.

3. The downhole assembly of claim 1, wherein the bypass restrictor is positioned along a radial edge of the opening.

4. The downhole assembly of claim 1, wherein the bypass restrictor is positioned continuously along an entirety of the outer surface of the window joint facing the inner surface of the tubular element.

5. The downhole assembly of claim 1, wherein the downhole assembly further comprises the wiper plug, the wiper plug having at least one radial wiper conforming to a cross-sectional area of an interior of the tubular element and further conforming to a cross-sectional area bounded by an inner surface of the window joint and the inner surface of the tubular element, the wiper plug operable for pushing cement slurry contacting the second end through the tubular element in response to a pressure communicated to the first end by the pressurized fluid and further operable for pushing the cement slurry through the tubular element and over the window joint.

6. A downhole assembly comprising:

a tubular element;

a wiper plug having a first end, a second end, and at least one radial wiper conforming to a cross-sectional area of an interior of the tubular element, the wiper operable for pushing cement slurry contacting the second end through the tubular element in response to a pressure communicated to the first end by a pressurized fluid;

a window joint positioned within the tubular element and having an opening radially extending through the window joint, the radial wiper of the wiper plug conforming to a cross-sectional area bounded by an inner surface of the window joint and an inner surface of the tubular element, the wiper plug further operable for pushing the cement slurry through the window joint; and a bypass restrictor positioned adjacent to the opening and in an annulus between an outer surface of the window joint and the inner surface of the tubular element, the bypass restrictor operable for reducing an amount of the pressurized fluid flowing from the first end to the second end through the opening and the annulus, wherein the bypass restrictor is a material selected from the group consisting of a filler material positioned in the annulus, a layer of grease, a layer of resin, a layer of epoxy, a layer of hardened foam, and a layer of swellable material.

7. The downhole assembly of claim 6, wherein the swellable material is swellable in response to exposure to a setting fluid.

8. The downhole assembly of claim 7, wherein the setting fluid includes water.

9. The downhole assembly of claim 7, wherein the setting fluid includes hydrocarbon.

10. A method comprising:

running a tubular element into a wellbore, the tubular element containing a window joint positioned within the tubular element and a bypass restrictor positioned in an annulus between an outer surface of the window joint and an inner surface of the tubular element;

propelling, via a pressurized fluid in contact with a wiper plug, the wiper plug through the tubular element through an inner region between the inner surface of the tubular element and an inner surface of the window joint;

reducing, via the bypass restrictor, an amount of pressurized fluid bypassing the wiper plug and the inner region via the annulus; and introducing a setting fluid to the bypass restrictor in the annulus, the setting fluid causing a material in the bypass restrictor to swell for reducing the amount of pressurized fluid bypassing the wiper plug and the inner region via the annulus.

11. The method of claim 10, wherein introducing a setting fluid to the bypass restrictor in the annulus includes introducing the setting fluid to the bypass restrictor before running the tubular element into the wellbore.

12. The method of claim 10, wherein introducing a setting fluid to the bypass restrictor in the annulus includes introducing the setting fluid to the bypass restrictor after running the tubular element into the wellbore.

13. The method of claim 10, wherein introducing a setting fluid to the bypass restrictor in the annulus includes introducing a setting fluid including water.

14. The method of claim 10, wherein introducing a setting fluid to the bypass restrictor in the annulus includes introducing a setting fluid including hydrocarbon.

* * * * *